US006312291B1

(12) United States Patent
Wu

(10) Patent No.: US 6,312,291 B1
(45) Date of Patent: Nov. 6, 2001

(54) HIGH FREQUENCY CONNECTOR

(76) Inventor: Chou Wu, No. 19-4, Kao Shuang Village, Ping Ghen City, Taoyung (TW)

( * ) Notice: Subject to any disclaimer, the term of this patent is extended or adjusted under 35 U.S.C. 154(b) by 0 days.

(21) Appl. No.: 09/589,155

(22) Filed: Jun. 8, 2000

(51) Int. Cl.[7] ..... H01R 24/00
(52) U.S. Cl. ..... 439/676
(58) Field of Search ..... 439/676, 344, 439/677, 682, 686

(56) References Cited

U.S. PATENT DOCUMENTS 5,403,200 * 4/1995 Chen ..... 439/404
5,766,043 * 6/1998 Talend ..... 439/676
5,957,730 * 9/1999 Wang ..... 439/676

* cited by examiner

*Primary Examiner*—Tulsidas Patel
(74) *Attorney, Agent, or Firm*—Nath & Associates PLLC; Harold L. Novick; Marvin C. Berkowitz

(57) ABSTRACT

A high frequency connector comprises a connector body and metal conductive wires. An embedding groove is installed on the longitudinal wall of the connector body. An embedding block is installed with respect to the embedded groove; and the embedded block has a plurality of through holes. The metal conductive wire includes a first conductive wire and a second conductive wire. The fixing end of the second conductive wire is inserted to the through hole of the embedding block, and a bent portion in the middle section of the second conductive wire resists against the lower surface of the embedded groove. As a consequence, a high frequency connector for transferring high frequency signals is constructed.

2 Claims, 2 Drawing Sheets

HIGH FREQUENCY CONNECTOR

FIELD OF THE INVENTION

The present invention relates to a structure of a high frequency connector, and especially to a high frequency connector in the transformation of high frequency signal, in which the contact end of the second conductive wire is lower than that of the first conductive wire.

BACKGROUND OF THE INVENTION

For connectors used in transformation of high frequency signals, in general, the metal conductive wire used is divided into a first conductive wire and a second conductive wire. The contact end of the second conductive wire is set to be lower than that of the first conductive wire. Therefore, the positioning of the second conductive wire to the connector body is different from that of the first conductive wire. FIGS. 4 to 6 shows the positioning of the second conductive wire, the fixing end of the second conductive wire is inserted into a through hole upwards according to the position of the connector body.

The prior art second conductive wire of connector assembled according to aforesaid way is not obviously stable with respect to the connector body. Namely, in using the connector, the second conductive wire will vibrate or slide down. Therefore, the connector will not achieve a high speed signal transformation as expected.

In order to resolve the problem that the second conductive wire is unstable in position, in general, after the second conductive wire is assembled to the connector body, a high frequency heating serves to enhance the positioning effect. However, such way will induce the increase of cost.

SUMMARY OF THE INVENTION

Accordingly, the primary object of the present invention is to provide a high frequency connector comprising a connector body and metal conductive wires. An embedding groove is installed on the longitudinal wall of the connector body. An embedding block is installed with respect to the embedded groove; and the embedded block has a plurality of through holes; and the metal conductive wire includes a first conductive wire and a second conductive wire.

Therefore, the fixing end of the second conductive wire is inserted to the through hole of the embedding block, and a bent portion in the middle section of the second conductive wire resists against the lower surface of the embedded groove.

The various objects and advantages of the present invention will be more readily understood from the following detailed description when reading in conjunction with the appended drawing.

DETAILED DESCRIPTION OF THE PREFERRED EMBODIMENTS

Figure 1:
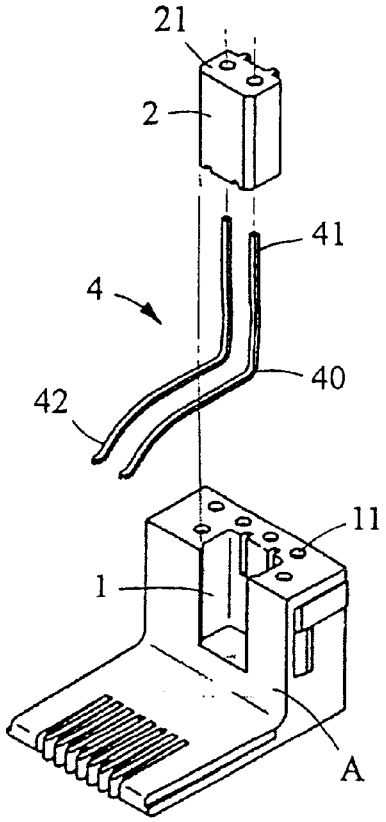
FIG. 1 is a perspective view of the present invention.
Figure 2:
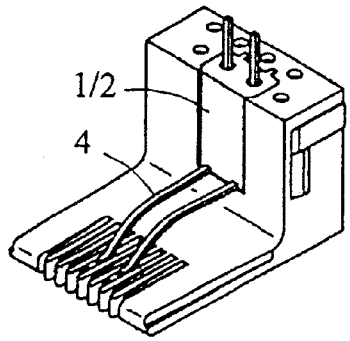
FIG. 2 is a schematic view showing the positioning of the second conductive wire and the embedding block.
Figure 3:
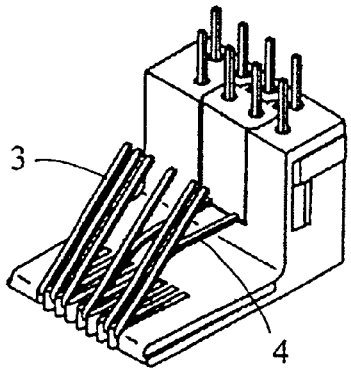
FIG. 3 is schematic view showing the assembly of the connector in the present invention.
Figure 4:
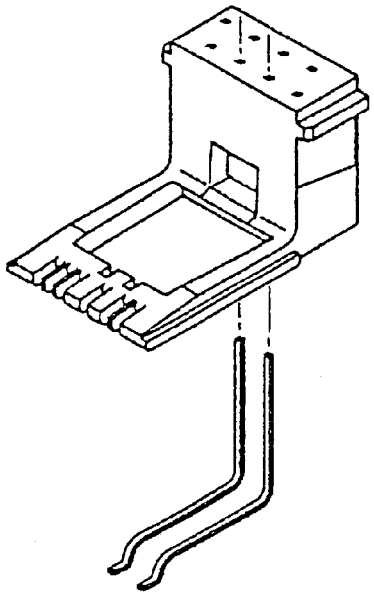
FIG. 4 (PRIOR ART)
FIGS. 4 to 6 are schematic views of the high frequency connector in the prior art.
Figure 5:
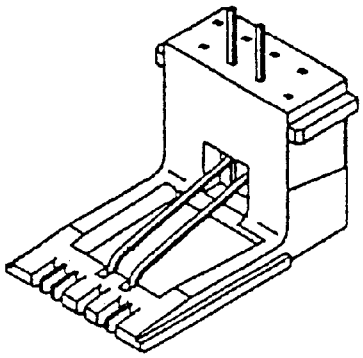
FIG. 5 (PRIOR ART)
Figure 6:
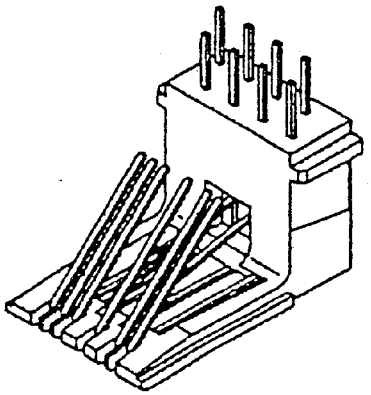
FIG. 6 (PRIOR ART)

With reference to FIGS. 1, 2 and 3, the high frequency connector of the present invention is illustrated.

The high frequency connector mainly includes a connector body A and metal conductive wires. An embedded groove 1 and a plurality of through holes 11 are formed on a longitudinal wall of the connector body A.

Moreover, an embedding block 2 is installed on the embedded groove 1. The embedding block 2 may be embedded with the embedded groove 1. Another, the embedding block 2 is installed with a plurality of through holes 21 (in this embodiment, two through holes are illustrated).

Further, the metal conductive wire includes a first conductive wire 3 and a second conductive wire 4. The second conductive wire 4 is bent with an angle at an approximately middle section 40. One end thereof is a fixing end 41, while another end is a contact tend 42. The fixing end 41 of the second conductive wire 4 is inserted into the through hole 21 of the embedding block 2, and the contact end 42 extends to the front end the connector body A.

In assembling the aforesaid structure, at first, the fixing end 41 of the second conductive wire 4 is inserted into the through hole 21 of the embedding block 2. Next, the embedding block 2 is embedded in the embedded groove 1 for being positioned. After completing the assembly of the second conductive wire 4 and the embedding block 2, finally, the first conductive wire 3 is assembled for machining to a preset position.

Since the fixing end 41 of the second conductive wire 4 is included in the through hole 21, and the middle section 40 thereof resists-against at the lower surface of the embedding block 1, the second conductive wire 4 can be steadily retained in the connector body A for being positioned without vibration or sliding.

As for the method for embedding the embedding block 2 to the embedded groove 1, many well known means, for example, by tight assembly or by tenons, can be used in this application, which is not confined in the present invention.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A high frequency connector having a male portion and a female portion, the male and female portions being cooperatively engageable with each other, one of the male and female portions comprising:

a connector body having a longitudinal wall;

first and second metal conductive wires, the second conductive wire having a first end and a bent portion in a middle section thereof;

a groove in the longitudinal wall of the connector body; and a block cooperatively engaged with said groove, said block having a plurality of through holes;

wherein the first end of the second conductive wire is disposed in one of the plurality of through holes of the block, and the bent portion rests against a surface of the groove.

2. The high frequency connector as claimed in claim 1, wherein the block is disposed in the groove of the connector body to fix a position of the second conductive wires relative thereto.

* * * * *